US007731836B2

(12) United States Patent
Nicolaos et al.

(10) Patent No.: US 7,731,836 B2
(45) Date of Patent: Jun. 8, 2010

(54) PROCESS FOR THE DESULFURIZATION OF GASOLINES COMPRISING A DESULFURIZATION BY ADSORPTION OF THE LIGHT FRACTION AND A HYDRODESULFURIZATION OF THE HEAVY FRACTION

(75) Inventors: Alexandre Nicolaos, Lyons (FR); Florent Picard, Communay (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 11/819,053

(22) Filed: Jun. 25, 2007

(65) Prior Publication Data

US 2007/0261993 A1 Nov. 15, 2007

Related U.S. Application Data

(63) Continuation of application No. PCT/FR2006/001885, filed on Aug. 2, 2006.

(30) Foreign Application Priority Data

Aug. 8, 2005 (FR) ..... 05 08474

(51) Int. Cl.
*C10G 45/00* (2006.01)

(52) U.S. Cl. ..... 208/208 R; 208/227; 208/243; 208/244; 208/299

(58) Field of Classification Search ..... 208/208 R, 208/226, 227, 238, 243, 244, 250, 299
See application file for complete search history.

(56) References Cited

U.S. PATENT DOCUMENTS

| | | | | |
|---|---|---|---|---|
| 5,011,805 | A * | 4/1991 | Dessau | 502/66 |
| 6,482,316 | B1 | 11/2002 | Bal | |
| 2003/0042175 | A1 * | 3/2003 | Debuisschert et al. | 208/211 |
| 2005/0061712 | A1 | 3/2005 | Nicolaos et al. | |
| 2005/0092655 | A1 | 5/2005 | Nicolaos et al. | |

OTHER PUBLICATIONS

Gary, J. and Handwerk, G. (1994) Petroleum Refining: Technology and Economics, 3rd ed. New York: Marcel Dekker.*

* cited by examiner

*Primary Examiner*—Robert J Hill, Jr.
*Assistant Examiner*—Brian McCaig
(74) *Attorney, Agent, or Firm*—Millen, White, Zelano & Branigan, P.C.

(57) ABSTRACT

The invention relates to a process for the desulfurization of gasolines comprising a stage for fractionation of said gasoline into a light fraction that comprises thiophenic compounds such as thiophene or methylthiophenes, and a heavy fraction that concentrates the heaviest aromatic sulfur-containing compounds. The heavy fraction is treated by hydrodesulfurization, while the light fraction is brought into contact with a solid adsorbent that makes it possible to eliminate at least partially said light thiophenic compounds, whereby said adsorbent solid is regenerated by a flow internal to the process.

22 Claims, 1 Drawing Sheet

Figure 1:
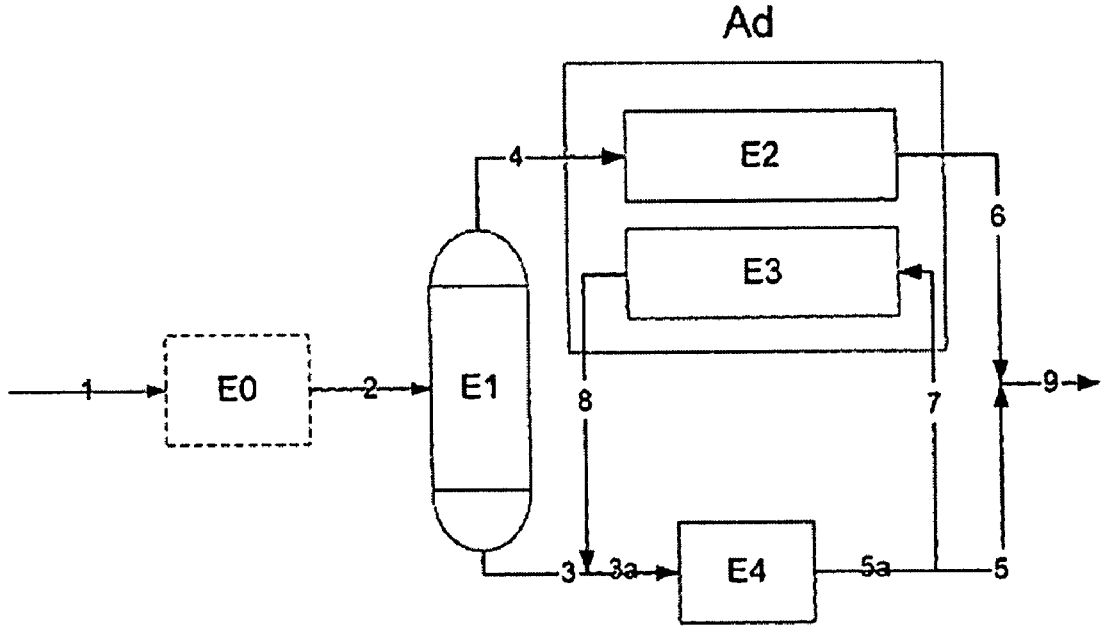

PROCESS FOR THE DESULFURIZATION OF GASOLINES COMPRISING A DESULFURIZATION BY ADSORPTION OF THE LIGHT FRACTION AND A HYDRODESULFURIZATION OF THE HEAVY FRACTION

This application is a Continuation of International Application Number PCT/FR2006/001885, filed Aug. 2, 2006, which is incorporated by reference herein.

FIELD OF THE INVENTION

This invention relates to a process for the production of gasoline with low sulfur content and a high octane number from a starting gasoline that comprises olefins and sulfur-containing compounds of thiophenic type.

Typically, the gasoline that is covered by the invention is a catalytic cracking gasoline, but it can also be a gasoline that is obtained from a conversion process such as coking, or even a direct distillation gasoline, or even more generally, any mixture of said gasolines.

This process therefore particularly finds its application in the desulfurization of the gasolines that are obtained from a catalytic cracking process, a catalytic cracking process in a fluidized bed, a coking process, a visbreaking process or a pyrolysis process.

This process should be considered as an improvement of the Application FR 2 857 973. The improvement described in this invention relative to the Patent Application FR 2 857 973 consists in using a flow internal to the process to regenerate the adsorbent solid that is used to desulfurize the light fraction by adsorption. A flow internal to the process is defined as a flow that is generated by one of the units that forms an integral part of the process that is the object of the invention.

EXAMINATION OF THE PRIOR ART

The prior art that is pertinent relative to this invention consists of teachings relative to a desulfurization of gasoline with decomposition of said gasoline into two fractions that each are the object of a specific treatment, a desulfurization by adsorption for the so-called light fraction and a hydrodesulfurization for the so-called heavy fraction.

The Patent Application FR 2 857 973 describes such a process in which the gasoline to be treated is divided into a light fraction that is sent into a unit for desulfurization by adsorption, and a heavy fraction that is sent into a unit for traditional hydrodesulfurization.

The Application WO 02/36718 proposes separating the FCC gasoline into a light portion that is rich in olefins and that comprises only mercaptan-type sulfur-containing compounds and into a heavy portion that concentrates the thiophene and its derivatives (regrouped under the term of thiophenic compounds), and the heaviest sulfur-containing compounds.

The mercaptans that are present in the light fraction are then eliminated by a process that implements an extractive soda solution. The heavy fraction is desulfurized by a standard hydrodesulfurization process.

The fraction point of the two fractions is relatively low, however (less than 75° C. in the above-mentioned application), which limits the advantage of such a process, whereby the light fraction comprises a reduced portion of hydrocarbons contained in the starting gasoline.

The U.S. Pat. No. 6,482,316 B1 proposes desulfurizing by adsorption a gasoline whose boiling point is between 10° C. and 150° C. and regenerating the adsorbent solid that is used by a fluid of the refinery whose boiling point is in the same temperature range. The patent in question specifies in a dependent claim that the preferred flow for carrying out said regeneration is a reformate, therefore a flow that is rich in aromatic compounds, with a distillation interval that is typically between 10° C. and 150° C.

Unlike U.S. Pat. No. 6,482,316, the process that is the object of this invention is optionally able to treat a gasoline whose boiling point is between 25° C. and 300° C.

In addition, said gasoline is separated by distillation into a light gasoline and a heavy gasoline. The light fraction is desulfurized in a unit for desulfurization by adsorption, and the heavy fraction is desulfurized in a hydrodesulfurization unit.

The regeneration of the adsorbent that is used for desulfurizing the light fraction is done with a fraction of the desulfurized heavy fraction whose final boiling point can go up to 300° C. This fraction of the desulfurized heavy fraction contains aromatic compounds but is separate from a reformate by its distillation interval.

In the case of the use of the reformate as an agent for regeneration of the adsorbent solid, as taught in the U.S. Pat. No. 6,428,316, the regeneration of the reformate that is contaminated by the sulfur is generally done by hydrotreatment, but this produces an imbalance of the flows of the refinery that may be costly and also brings about a reduction of the quantity of reformate available to be used in, for example, petrochemistry.

The use of a portion of the desulfurized heavy fraction to regenerate the adsorbent solid used in the treatment by adsorption of the light fraction is therefore an innovative and more economical solution than the solutions of the prior art because it does not disturb the standard refining scheme and can be applied in all refineries, in particular in those that are not equipped with a process for reforming gasolines.

SUMMARY DESCRIPTION OF THE FIG. 1

FIG. 1 represents a diagram of the process according to the invention in which the optional unit E0 is indicated by dotted lines.

SUMMARY DESCRIPTION OF THE INVENTION

This invention relates to a process for the desulfurization of a gasoline containing sulfur and unsaturated compounds, generally a catalytic cracking gasoline, comprising at least one unit for separation of said gasoline into a light fraction and a heavy fraction, a unit for desulfurization by adsorption of said light fraction, and a unit for hydrodesulfurization of said heavy fraction, whereby the process is characterized in that the regeneration of the adsorbent solid that is used in the unit for desulfurization by adsorption of the light fraction is carried out by means of a portion of said desulfurized heavy fraction, i.e., after its desulfurization in the hydrodesulfurization unit.

More specifically, the process according to the invention is a process for the production of a desulfurized gasoline with a high octane number from a starting gasoline that comprises olefins and thiophenic compounds, whereby said process comprises the following stages:

a) a stage for distillation of the starting gasoline into at least two fractions including:

a light fraction containing the majority of olefins with 5 and 6 carbon atoms, as well as thiophene, and preferably methylthiophenes, a heavy fraction that no longer contains olefins with 5 carbon atoms and concentrates the heavy sulfur-containing compounds such as the benzothiophenes, b) a stage for desulfurization of said light fraction by adsorption of the sulfur-containing compounds on an adsorbent solid, whereby the adsorbent solid that is used is selected from the group that consists of silicas, aluminas, zeolites, active carbons, resins, clays, metal oxides and reduced metals, c) a stage for hydrodesulfurization of said heavy fraction on a catalyst that contains at least one metal of group VIII and a metal of group VIb, under standard hydrodesulfurization conditions, whereby the regeneration of the adsorbent solid is carried out by means of a desorption solvent that is a portion of the effluent of the hydrodesulfurization stage of the heavy fraction, and whereby the additional portion of the effluent of said hydrodesulfurization stage is mixed with the effluent of the desulfurization stage by adsorption of the light fraction to constitute the desulfurized gasoline with a high octane number.

This process makes it possible to obtain both a better selectivity of adsorption with regard to the thiophenic compounds that are present in the initial feedstock, a reduced hydrogen consumption, and it also makes it possible to reach future standards of sulfur in the gasolines.

It should be noted that the process applies to gasolines that have a very variable sulfur level that can range from several tens of ppm to several percent.

The process according to the invention makes it possible to recover a gasoline with characteristics that are very similar to those of the gasoline to be treated with a rate of desulfurization that is at least 50% and preferably at least 80%.

As has been mentioned in the preceding paragraph, the process according to the invention does not disturb the refining scheme and applies even to refineries that do not have a gasoline reforming unit.

In contrast, this invention makes it possible to carry out the desulfurization of said hydrocarbon fraction by reducing the octane loss by hydrogenation of olefins since this octane loss is primarily sensitive to the heavy fraction of the gasoline to be treated, whereby the light fraction is the object of a desulfurization by adsorption, therefore with preservation of the octane number. The result is that the octane number of the gasoline that is produced is very little affected by the process, and it is a value that is 10% less than the octane number of the gasoline to be treated, and most often a value that is 5% less than the octane number of the gasoline to be treated.

DETAILED DESCRIPTION OF THE INVENTION

The following description is provided by way of illustration and does not at all limit the field of application of this process. In this description, a gasoline that is obtained from a catalytic cracking process, representative of the fractions to which this process is likely to be applied, was randomly selected as a hydrocarbon fraction to be treated.

Stage of Fractionation of the Gasoline to be Treated (Stage a):

According to a first embodiment (method I) of the invention, the gasoline is fractionated into two fractions:

A light fraction that contains the majority of the olefins with 5 and 6 carbon atoms as well as thiophene, and preferably methylthiophenes, A heavy fraction that no longer contains olefins with 5 carbon atoms and concentrates the heavy sulfur-containing compounds such as the benzothiophenes.

The light fraction generally has a final point of between about 90° C. and about 200° C., preferably between about 90° C. and about 160° C., and very preferably between about 90° C. and 110° C.

This separation is conventionally carried out by means of a distillation column.

According to a second embodiment of the invention (method II), the gasoline is distilled into three fractions:

A light fraction comprising the compounds contained in the starting gasoline whose boiling point is less than the boiling point of the thiophene, An intermediate fraction that comprises at least the thiophene, and of which the final boiling point is between about 90° C. and about 200° C., preferably between about 90° C. and about 160° C., and very preferably between about 90° C. and about 110° C.

A heavy fraction that concentrates the heavy sulfur-containing compounds such as the benzothiophenes.

The fraction point of the distillation that makes it possible to fractionate the gasoline to be treated into two or three fractions is selected based on the composition of the starting gasoline to be treated and/or based on the concentration of aromatic hydrocarbons present in the light fraction (method I) or in the intermediate fraction (method II) after fractionation.

Unexpectedly, it was actually found by the applicant that during the stage b) for adsorption that is described below, the effectiveness of the desulfurization is better if the percentage by weight of aromatic compounds in said light fraction is less than 25% and preferably less than 10% and even more preferably less than 5%.

According to a preferred embodiment of the invention, the fraction point of the light fraction will be selected based on the composition of the gasoline to be treated so as to have a percentage by weight of aromatic compounds that are present in said light fraction that is less than 25%, preferably less than 10%, and more preferably less than 5%.

Adsorption/Desorption Stage of the Light Fraction (Stage b):

This stage consists in eliminating the sulfur-containing compounds that are present in the light fraction (method I) or in the intermediate fraction (method II) that is obtained from stage a).

According to a preferred embodiment of the invention, said fractions have previously been depleted of mercaptan-type compounds, for example by a selective hydrogenation stage as described below.

This adsorption stage is carried out by bringing the feedstock to be treated into contact with an adsorbent solid that has a high affinity with the sulfur-containing compounds, preferably the thiophenic compounds.

The solids that are used as adsorbent can be selected from among the following adsorbent families; the silicas, the aluminas, the zeolites, preferably the faujasites, and preferably the faujasites that are partially exchanged with cesium, the active carbons, the resins, clays, metal oxides and reduced metals.

It is also possible to use an adsorbent solid that has an adsorption capacity that is increased with regard to the sulfur-containing compounds, by treatments of suitable physical surfaces, for example temperature treatments, or chemical surface treatments, for example the grafting of specific molecules on the surface.

It is also preferable to use solids whose residual acidity is controlled so as to prevent any coking reaction of the olefins that is likely to bring about a rapid ageing of the solid that is used. To avoid this type of phenomenon, it is possible, for example, to carry out treatments with potash or with soda.

The regeneration of the adsorbent solid will be done via adsorption/regeneration cycles that are known in the art of one skilled in the art. The experimental conditions of the adsorption and the regeneration will be selected so as to maximize the dynamic capacity of the solid, i.e., the difference between the amount of sulfur collected during the adsorption and the amount of sulfur remaining in the solid after regeneration.

When the adsorption is carried out in liquid phase, it can be done under mild temperature and pressure conditions, making it possible to remain in liquid phase and typically ranging from 0° C. to 200° C., under a pressure ranging from 0.1 MPa to 30 MPa, (1 MPa=10 bar) and preferably from 10° C. to 100° C. under a pressure ranging from 0.2 MPa to 10 MPa.

The regeneration of the adsorbent solid is done by using a fluid or regeneration solvent that has an adequately high desorption power. In general, the regeneration solvent is selected to replace the gasoline that is retained in the pores of the adsorbent solid, then to bring about the desorption of the other compounds retained on the solid, in particular sulfur-containing compounds.

Preferably, within the scope of the invention, the regeneration solvent will comprise at least a portion of aromatic-type compounds. Said portion of aromatic compounds will be at least 10% by weight and preferably at least 25% by weight.

In contrast, the regeneration solvent is characterized by a sulfur content that is less than the sulfur content of the gasoline that is desulfurized by adsorption. Generally, the sulfur content of the regeneration solvent is less than 100 ppm, preferably less than 50 ppm, and very preferably less than 20 ppm.

According to the invention, a portion of the heavy fraction that results from the separation of the gasoline to be treated into two fractions according to stage a), whereby said heavy fraction has been desulfurized in the hydrodesulfurization unit (HDS) that is the object of stage c) of the process according to the invention, will preferably be used as a solvent for regeneration of the adsorbent solid.

The regeneration solvent according to the invention is therefore a portion of the desulfurized heavy fraction, whereby said portion is calculated to make possible the optimum regeneration of the adsorbent solid.

It is preferable, furthermore, to carry out the regeneration at a temperature of greater than 50° C., preferably greater than 80° C., and even more preferably greater than 100° C., while remaining in liquid phase, to promote the desorption of sulfur-containing molecules and thus to use a minimum portion of said desulfurized heavy fraction to regenerate the adsorbent solid.

The regeneration effluent that contains the sulfur-containing molecules initially retained on the adsorbent solid is recycled at the inlet of the hydrodesulfurization unit of the heavy fraction.

Hydrodesulfurization Stage of the Heavy Fraction (Stage c):

The heavy fraction that is obtained from stage a) for distillation of the gasoline to be treated is subjected to a hydrodesulfurization treatment. This stage can be carried out by passage of gasoline, in the presence of hydrogen, on a catalyst that comprises at least one element of group VIII that is selected from the group that consists of iron, ruthenium, osmium, cobalt, rhodium, iridium, nickel, palladium or platinum, and at least one element of group VIB that is selected from the group that consists of chromium, molybdenum and tungsten, each of these elements being found at least in part in sulfide form.

The reaction temperature is generally between 220° C. and 340° C. under a pressure of between about 1 MPa and 5 MPa (1 MPa=10 bar).

The hourly volumetric flow rate is between about 1 $h^{-1}$ and 20 $h^{-1}$.

The ratio of the hydrogen flow rate to the feedstock flow rate is between 100 liters/liter and 600 liters/liter, expressed in normal liters of hydrogen per liter of gasoline.

The catalyst that is used to carry out the hydrodesulfurization of the heavy fraction comprises between 0.5% and 15% by weight of metal of group VIII, this percentage expressed in the form of oxide.

The content by weight of metal of group VIB is generally between 1.5% and 60% by weight and preferably between 2% and 50% by weight.

The element of group VIII is preferably cobalt, and the element of group VIB is preferably molybdenum or tungsten.

The substrate of the catalyst is usually a porous solid, such as, for example, magnesia, silica, titanium oxide or alumina, alone or in a mixture.

The effluent of the hydrodesulfurization stage c) is mixed with the adsorption effluent of stage b) for forming the desulfurized gasoline with a high octane number.

The sulfur content of said gasoline that results from the process is reduced by at least 50% and preferably by at least 80% relative to the starting gasoline.

This hydrodesulfurization stage c) can also comprise a final hydrodesulfurization stage that is carried out on a catalyst that comprises at least one element of group VIII, preferably selected from the group that is formed by nickel, cobalt or iron.

The metal content of the catalyst of the final stage is generally between about 1% and about 60% by weight in oxide form. This final stage makes it possible to eliminate the residual sulfur-containing compounds and primarily the saturated sulfur-containing compounds that will have been formed during the first hydrodesulfurization stage.

The temperature of the final stage is generally between 240° C. and 360° C. and is preferably greater by at least 10° C. than the initial temperature of the hydrodesulfurization stage.

The pressure is between about 1 MPa and 5 MPa. The hourly volumetric flow rate is between about 1 $h^{-1}$ and 20 $h^{-1}$. The ratio of the hydrogen flow rate to the feedstock flow rate is between 100 liters/liter and 600 liters/liter, expressed in normal liters of hydrogen per liter of gasoline.

Optional Stage of Selective Hydrogenation of the Gasoline to be Treated:

This optional stage, used upstream from stages a), b) and c), is designed to eliminate, at least partially, the diolefins that are present in the gasoline and to transform the light sulfur-containing compounds by an increase in weight. The diolefins are actually precursors of gums that polymerize in the reactors of hydrodesulfurization or adsorption, in particular when the adsorbent solid has an acidity, and therefore limit the service life thereof. The diolefins are therefore hydrogenated in olefins during this stage.

This stage also makes it possible to transform the light sulfur-containing compounds, such as the mercaptans, sulfides and CS2, whose boiling point is generally less than that of thiophene, into heavier sulfur-containing compounds whose boiling point is greater than that of thiophene, by reaction with the olefins that are present in the feedstock.

According to this invention, a majority of said thus formed heavy compounds will be evacuated in the heavy fraction after fractionation (stage a).

The selective hydrogenation stage generally takes place in the presence of a catalyst that comprises at least one metal of group VIII, preferably selected from the group that is formed by platinum, palladium and nickel, deposited on a substrate.

For example, a catalyst that contains 1% to 20% by weight of nickel, deposited on an inert substrate, such as, for example, alumina, silica, silica-alumina, or a nickel aluminate, will be used. The substrate preferably will contain at least 50% of alumina.

Another metal of group VIB, such as, for example, molybdenum or tungsten, optionally can be combined with the metal of group VIII to form a bimetallic catalyst. This metal of group VIB will be deposited at a rate of 1% by weight to 20% by weight on the substrate.

The selection of the operating conditions of the selective hydrogenation stage is particularly important. The operation will most generally be performed under pressure in the presence of an amount of hydrogen that slightly exceeds the stoichiometric value that is necessary to hydrogenate the diolefins. The hydrogen and the feedstock to be treated are injected in upward or downward flows into a preferably fixed catalyst bed reactor.

The temperature is generally between 50° C. and 300° C., preferably between 80° C. and 250° C., and even more preferably between 120° C. and 210° C.

The pressure is selected to maintain more than 80%, and preferably more than 95%, by weight of the gasoline to be treated in liquid phase in the reactor. It is most generally from 0.4 MPa to 5 MPa, and preferably between 1 MPa to 4 MPa.

The volumetric flow rate is generally between 1 $h^{-1}$ and 12 $h^{-1}$, and preferably between 2 $h^{-1}$ and 10 $h^{-1}$.

The light fraction of the catalytic cracking gasoline fraction can contain up to several % by weight of diolefins. After hydrogenation, the diolefin content is reduced to less than 3000 ppm, preferably less than 2500 ppm, and very preferably less than 1500 ppm.

Concomitantly to the reaction of selective hydrogenation of diolefins, an isomerization of the double bond of outside olefins takes place, leading to the formation of internal olefins. This isomerization consequently has a slight gain in the octane number due to the fact that the inside olefins have an octane number that is generally greater than that of the terminal olefins.

According to an embodiment of the invention, the selective hydrogenation stage takes place in a catalytic reactor for hydrogenation comprising a catalytic reaction zone through which passes the entire feedstock and the amount of hydrogen that is necessary for carrying out the desired reactions.

The invention will be better understood from reading the following description, in relation to FIG. 1, corresponding to an embodiment of the process according to the invention (method I). The gasoline to be treated that is obtained from a catalytic cracking unit (not shown in FIG. 1) is in some cases sent via the line 1 into a reactor E0 for selective hydrogenation, mixed with a flow of a gas that comprises hydrogen (not shown in FIG. 1). Let us recall that the selective hydrogenation unit E0 is optional.

The effluent that is obtained from reactor E0 is sent via the line 2 to a distillation column E1 that produces a light fraction at the top that is evacuated via the line (4) and a heavy fraction at the bottom that is evacuated via the line (3).

The heavy fraction (3) that is obtained from the distillation column E1 is mixed with the desorption solvent (8) of the unit for desulfurization by adsorption (Ad) in desorption phase for forming the feedstock (3*a*).

The feedstock (3*a*) that results from the mixing of lines (3) and (8) is introduced into the hydrodesulfurization reactor E4.

The effluent (5*a*) of the hydrodesulfurization reactor E4 is separated into one portion (7) that is used for the regeneration of the unit for desulfurization by adsorption (Ad) and into one additional portion (5) that is mixed with the effluent (6) of the unit for desulfurization by adsorption (Ad) in adsorption phase for forming the desulfurized gasoline (9) that is directed toward the gasoline pool.

The light fraction that is recovered via the line (4) is sent to the desulfurization unit (Ad).

The unit for desulfurization by adsorption (Ad) comprises at least two volumes working alternately in adsorption, in FIG. 1 the volume (E2), and by desorption, in FIG. 1 the volume (E3).

At the end of a certain time, the volume (E2) switches to the regeneration phase, and the volume (E3) switches to the adsorption phase.

The alternation of the adsorption phase with the regeneration phase is done owing to additional lines and systems of opening and closing valves, not shown in FIG. 1.

The volume E3 is supplied with desorption solvent via the line (7) that consists of a fraction of the desulfurization effluent obtained from the hydrodesulfurization unit E4.

EXAMPLE

The nonlimiting example that follows makes it possible to better understand the advantages of this invention.

A gasoline I that is representative of a catalytic cracking gasoline is synthesized by incorporating the proportions of paraffins (n-heptane, isooctane), olefins (1-hexene, 1-dodecene), aromatic compounds (toluene, metaxylene) and sulfur-containing compounds (thiophene, benzothiophene) that are usually encountered in a cracking gasoline.

Table 1 provides the characteristics of gasoline I.

TABLE 1

| Compound | Mass (g) | % by Weight | | |
|---|---|---|---|---|
| nC7 | 195.6 | 24.0 | | |
| Isooctane | 142.8 | 17.5 | | |
| 1 Hexene | 203.9 | 25.0 | | |
| 1-Dodecene | 102.0 | 12.5 | | |
| Toluene | 8.3 | 1.0 | | |
| Metaxylene | 162.6 | 19.9 | | |
| Thiophene | 0.11 | 0.01 | 50 | ppm of S |
| Benzothiophene | 0.51 | 0.06 | 150 | ppm of S |

A gasoline II that reproduces the proportions of paraffins (n-heptane), olefins (1-hexene), aromatic compounds (toluene) and sulfur-containing compounds (thiophene) of the light fraction obtained after a fractionation at 90° C. of the gasoline I has been synthesized.

Table 2 provides the characteristics of this gasoline II.

TABLE 2

| Compound | Mass (g) | % by Weight | | |
|---|---|---|---|---|
| n Heptane | 195.6 | 48.0 | | |
| 1 Hexene | 203.9 | 50.0 | | |
| Toluene | 8.3 | 2.0 | | |
| Thiophene | 0.11 | 0.03 | 100 | ppm of S |

A gasoline III that reproduces the proportions of paraffins (isooctane), olefins (1-dodecene), aromatic compounds (metaxylene) and sulfur-containing compounds (benzothiophene) of the heavy fraction that is obtained after a fractionation at 90° C. of the gasoline I has been synthesized.

Table 3 provides the characteristics of this gasoline III.

TABLE 3

| Compound | Mass (g) | % by Weight | | |
|---|---|---|---|---|
| Isooctane | 142.8 | 35.0 | | |
| 1-Dodecene | 102.0 | 25.0 | | |
| Metaxylene | 162.6 | 39.9 | | |
| Benzothiophene | 0.51 | 0.13 | 300 | ppm of S |

A gasoline IV that reproduces the proportions of paraffins (isooctane), olefins (1-dodecene), aromatic compounds (metaxylene) obtained by hydrodesulfurization of the gasoline III has been synthesized.

Table 4 provides the characteristics of this gasoline IV.

TABLE 4

| Compound | Mass (g) | % by Weight |
|---|---|---|
| Isooctane | 191.9 | 47.0 |
| 1-Dodecene | 52.9 | 13.0 |
| Metaxylene | 162.6 | 39.9 |

The synthetic gasoline II that represents the light fraction to be desulfurized by adsorption is sent using a liquid pump to an adsorption column that is filled with an NaCsX-type adsorbent.

This NaCsX solid is obtained by ion exchange carried out under dynamic conditions on an NaX zeolite with a CsCl aqueous solution concentrated to 1.8 mol/liter at a temperature of 90° C.

The adsorption column contains 20 ml of adsorbent solid, and it has been possible to desulfurize at least 100 ml of gasoline II with a sulfur content of less than 5 ppm of S.

The regeneration of the adsorbent solid is carried out by passing the synthetic gasoline IV at a temperature of 60° C. into the adsorption column.

The concentration of sulfur at the outlet greatly increases in a first step then returns to values close to 0 ppm of S after the passage of 100 ml of this feedstock, which indicates the end of the desorption stage.

This example demonstrates the capacity of the desulfurized heavy fraction (represented by the synthetic gasoline IV) that is obtained from the gasoline to be desulfurized (represented by the synthetic gasoline I) to desorb the sulfur that is contained in the adsorbent solid after the desulfurization stage by adsorption of the light fraction represented by the synthetic gasoline II.

The invention claimed is:

1. A process for the production of a desulfurized gasoline with a high octane number from a starting gasoline that comprises olefins and thiophenic compounds, said process comprising:

a) distilling the starting gasoline into at least two fractions including:

a light fraction containing a majority of olefins with 5 and 6 carbon atoms, as well as thiophene, having a final boiling point of 90 to 160° C., a heavy fraction that no longer contains olefins with 5 carbon atoms and concentrates heavy sulfur-containing compounds, having a final boiling point up to 300° C., b) desulfurizing said light fraction by adsorption of the sulfur-containing compounds on an adsorbent solid, whereby the adsorbent solid that is used is silicas, aluminas, zeolites, active carbons, resins, clays, metal oxides or reduced metals, c) hydrodesulfurizing of said heavy fraction on a catalyst that contains at least one metal of group VIII and a metal of group VIb, under standard hydrodesulfurization conditions, and regenerating the adsorbent solid at a temperature of greater than 50° C., while remaining in liquid phase with a desorption solvent that is a portion of the effluent of the hydrodesulfurization stage of the heavy fraction, recycling to hydrodesulfurization in (c) regeneration effluent containing sulfur-containing molecules initially retained on the adsorbent solid and mixing an additional portion of the effluent of said hydrodesulfurization stage with the effluent of the desulfurization (b) to constitute the desulfurized gasoline with a high octane number.

2. A process for the production of a gasoline according to claim 1, in which the light fraction has a content of aromatic compounds of less than 25% by weight.

3. A process for the production of a desulfurized gasoline according to claim 1, in which separation of the gasoline to be treated in (a) produces, in addition to the light and heavy fractions, an intermediate fraction that comprises at least thiophene and whose final boiling point is between 90° C. and 160° C.

4. A process for the production of a desulfurized gasoline according to claim 3, in which desulfurization by adsorption (b) is applied to the intermediate fraction that is obtained from the distillation of the gasoline into three fractions.

5. A process according to claim 3, wherein the intermediate fraction has a final boiling point between 90° and 130° C.

6. A process for the production of a desulfurized gasoline according to claim 1, in which the adsorbent solid that is used in desulfurization by adsorption (b) is zeolites.

7. A process according to claim 6, wherein the zeolites are faujasites, optionally partially exchanged with cesium.

8. A process for the production of a desulfurized gasoline according to claim 1, in which the adsorption (b) is carried out in liquid phase at a temperature of between 0° C. and 200° C., and at a pressure of between 0.1 MPa and 20 MPa.

9. A process according to claim 8, wherein the adsorption (b) is carried out at between 15°-100° C., and between 0.2-10 Mpa.

10. A process for the production of a desulfurized gasoline according to claim 1, in which the desorption (b) is operated at a temperature of more than 50° C.

11. A process for the production of a desulfurized gasoline according to claim 1, in which the hydrodesulfurization (c) of the heavy fraction is carried out on a catalyst that comprises between 0.5% and 15% by weight of a metal of group VIII and that comprises between 1.5% and 60% by weight of a metal of group VIb.

12. A process for the production of a gasoline according to claim 11, in which the metal of group VIII is cobalt, and the metal of group VIb is molybdenum or tungsten.

13. A process for the production of a desulfurized gasoline according to claim 1, in which separation of the gasoline fraction to be treated in (a) is preceded by selective hydrogenation, carried out on a catalyst that comprises at least one metal of group VIII.

14. A process according to claim 13, wherein the group VIII metal is platinum, palladium or nickel.

15. A process for the production of a gasoline according to claim 1, in which the hydrodesulfurization (c) of the heavy fraction is followed by a final stage that is carried out on a catalyst that comprises at least one element of group VIII.

16. A process for the production of a desulfurized gasoline according to claim 15, in which the temperature at which the final stage is carried out is between 240° C. and 360° C.

17. A process according to claim 16, wherein the temperature of the final stage is more than at least 10° C., greater than the initial temperature of the hydrodesulfurization (c).

18. A process according to claim 15, wherein the group VIII metal is nickel, cobalt or iron.

19. A process according to claim 1, wherein in (a) the light faction contains methylthiophenes, and the heavy fraction contains benzothiophenes.

20. A process accordingly to claim 1, wherein regenerating of the absorbent is carried out at greater than 80° C.

21. A process according to claim 1, wherein the light fraction has a final boiling point between 90 and 100° C.

22. A process for the production of a desulfurized gasoline with a high octane number from a starting gasoline that comprises olefins and thiophenic compounds, said process comprising:

a) distilling the starting gasoline into at least two fractions including:

a light fraction containing a majority of olefins with 5 and 6 carbon atoms, as well as thiophene, having a final boiling point of 90 to 160° C., a heavy fraction that no longer contains olefins with 5 carbon atoms and concentrates heavy sulfur-containing compounds, having a final boiling point of 300° C., d) desulfurizing said light fraction by adsorption of the sulfur-containing compounds on an adsorbent solid, whereby the adsorbent solid that is used is silicas, aluminas, zeolites, active carbons, resins, clays, metal oxides or reduced metals, e) hydrodesulfurizing of said heavy fraction on a catalyst that contains at least one metal of group VIII and a metal of group VIb, under standard hydrodesulfurization conditions, and regenerating the adsorbent solid at a temperature of greater than 50° C., while remaining in liquid phase with a desorption solvent that is a portion of the effluent of the hydrodesulfurization stage of the heavy fraction, recycling to hydrodesulfurization in (c) regeneration effluent containing sulfur-containing molecules initially retained on the adsorbent solid and mixing an additional portion of the effluent of said hydrodesulfurization stage with the effluent of the desulfurization (b) to constitute the desulfurized gasoline with a high octane number.

* * * * *

UNITED STATES PATENT AND TRADEMARK OFFICE

CERTIFICATE OF CORRECTION

PATENT NO. : 7,731,836 B2
APPLICATION NO. : 11/819053
DATED : June 8, 2010
INVENTOR(S) : Nicolaos et al.

It is certified that error appears in the above-identified patent and that said Letters Patent is hereby corrected as shown below:

Column 11, line 17 reads "tion has a final boiling point between 90 and 100ºC." should read --tion has a final boiling point between 90 and 110ºC.--

Signed and Sealed this

Thirty-first Day of August, 2010

David J. Kappos

David J. Kappos
*Director of the United States Patent and Trademark Office*